US007182038B2

(12) United States Patent
Dougherty

(10) Patent No.: US 7,182,038 B2
(45) Date of Patent: Feb. 27, 2007

(54) INTEGRATED SLIDING WINDSHIELD FOR A BOAT

(76) Inventor: Stephen Dougherty, 544 Air Park Rd., Edgewater, FL (US) 32132

( * ) Notice: Subject to any disclaimer, the term of this patent is extended or adjusted under 35 U.S.C. 154(b) by 28 days.

(21) Appl. No.: 11/157,705

(22) Filed: Jun. 21, 2005

(65) Prior Publication Data

US 2006/0000404 A1 Jan. 5, 2006

Related U.S. Application Data

(60) Provisional application No. 60/585,474, filed on Jul. 2, 2004.

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS

| | | | | |
|---|---|---|---|---|
| 4,442,881 | A * | 4/1984 | Monteath et al. | 160/25 |
| 4,606,571 | A * | 8/1986 | Fujita | 296/89 |
| 5,947,052 | A * | 9/1999 | Deising | 114/361 |
| 2003/0111101 | A1 * | 6/2003 | Tull | 135/88.01 |

* cited by examiner

*Primary Examiner*—Stephen Avila
(74) *Attorney, Agent, or Firm*—The Livingston Firm; Edward M. Livingston; Angela M. Miller

(57) ABSTRACT

An adjustably slidable windshield assembly for a boat having a window (6) mounted within channels (8) in frame members (4) attached to T-top supports (3) on a boat. At least one clamp mechanism (14) proximate each channel is provided which can be used to secure the window at any desired open or closed position. Handles (13) are provided to assist in raising and lowering the window.

12 Claims, 2 Drawing Sheets

INTEGRATED SLIDING WINDSHIELD FOR A BOAT

CROSS-REFERENCE TO RELATED APPLICATION

The benefit of U.S. Provisional Application No. 60/585,474, filed Jul. 2, 2004 is hereby claimed.

BACKGROUND OF THE INVENTION

This invention relates to boats and more particularly to a sliding windshield for a boat which is integrated into a T-top of a boat.

Many boats, particularly fishing boats, are designed to have a central console at which a person stands or sits to operate the boat. In order to protect the operator and perhaps others on the boat from sun and other elements, many boats are provided with T-tops which have supports manufactured of aluminum or stainless steel tubing, piping and/or extrusions. The T-top is normally covered with canvas or a hard fiberglass top. A T-top may incorporate built-in features, such as additional dry storage, housing for electronics, fishing rod holders, antennas, speakers and so forth.

Many T-tops are open on the front and sides and thus, although allowing ventilation, such T-tops provide little protection from cold winds, wind driven rain, sea spray and so forth. Thus, windshields are often provided in the front and sides of such T-tops. Unfortunately, however, the windshields are usually fixed in position, thereby removing the ventilation which is desirable to boat operators and occupants, especially on hot summer days.

Thus a need exists for a windshield for a boat that will provide protection and ventilation to the extent desired by the operator and occupants.

The present invention fulfills this need by providing a windshield system which incorporates a window, preferably made of acrylic or tempered glass, mounted between two side supports having channels within which the window can be slid to a desired opened position. A clamping means, which may comprise two plates mounted on each side of the windshield tightenable by a rotary knob, can be used to lock the window in any desired position to yield the desired ventilation for the operator and occupants. The present invention eliminates the need for framed or unframed windshields that are currently mounted to center consoles.

SUMMARY OF THE INVENTION

The primary object of the present invention is to provide a windshield system for a boat that provides a desired level of protection from the elements.

Another object of the present invention is to provide such a windshield system that also provides a desired level of ventilation to a boat operator and passengers.

A further object of the present invention is to provide such a windshield system that is integrated into the supporting structure of a T-top boat.

An even further object of the present invention is to provide such a windshield system that is adjustably slidable to any desired open position.

A further object of the present invention is to provide stronger and better protection against the elements than present windshield systems.

The present invention fulfills the above and other objects by providing a sliding windshield system for a boat having a window, two edges of which are contained within in a channel incorporated into supports, the channels being of sufficient width and length to accommodate the window in a slidable fashion. A means for holding the window in the desired location in the channel is provided, preferably a clamp having two plates on each side of the window which can be adjustably tightened by turning a knob to hold the window in any desired location within the channels.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
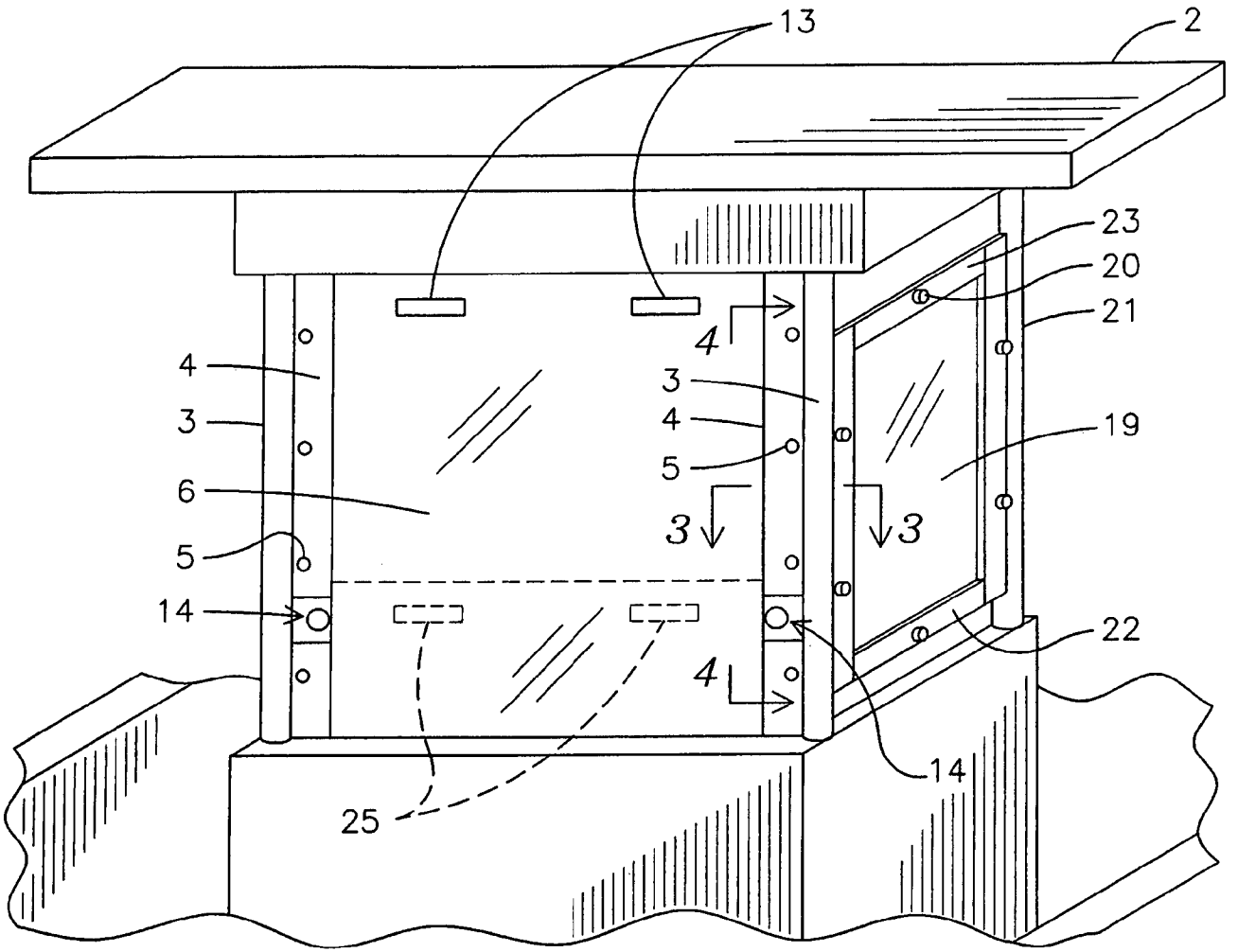
FIG. 1 is a front perspective view of the windshield system of the present invention integrated into a T-top on a boat.

For purposes of describing the preferred embodiment, the terminology used in reference to the numbered components in the drawings is as follows:

| | |
|---|---|
| 1. | Boat |
| 2. | T-top |
| 3. | Front side supports |
| 4. | Windshield holding frame members |
| 5. | Frame attachment fasteners |
| 6. | Windshield window |
| 7. | Connector |
| 8. | Windshield channel |
| 9. | Support channel |
| 10. | Front plates of frame member 4 |
| 11. | Rear plates of frame member 4 |
| 12. | Support ridge |
| 13. | Windshield handles |
| 14. | Windshield clamp |
| 15. | Clamp tightening knob |
| 16. | Threaded bolt |
| 17. | Nut |
| 18. | Gasket |
| 19. | Side window |
| 20. | Fasteners |
| 21. | Rear T-top support |
| 22. | Side bottom crossbar |
| 23. | Side top crossbar |
| 24. | Clamp plates |
| 25. | Lowered window |

With reference to the drawings, in FIG. 1 a boat in partial section is shown having a T-top 2 having two front side supports 3. The front side supports 3 are preferably made of tubular stainless steel attached at a bottom end to the boat 1. The supports 3 themselves may have channels to hold the windshield window 6, but the preferred embodiment as illustrated is to have frame members 4 with channels made of extruded plastic or other rigid material which are attached to supports 3.

As illustrated further in FIG. 1, handles 13 may be provided to assist in raising and lowering the windshield windows 6. The handles 13 may be made of plastic and secured to the window 6 proximate a top by fastening means, such as screws. Thus in operation, when the windshield clamps 14 are released by rotating the clamp tightening knob 15, a downward pull by one's hands on the handles 13 can lower the windshield window 6 to any desired open position in the channel, for instance, to the level indicated by the dotted line 25, at which point the clamp tightening knobs can be rotated to tighten the windshield clamp plates 24 against the windshield window to secure the window 6 in that open position.

Figure 2:
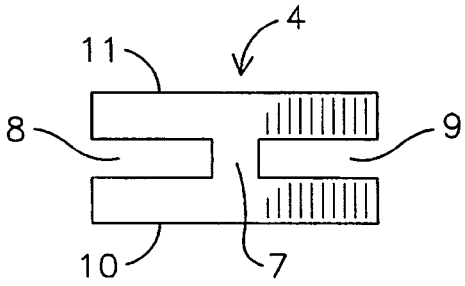
FIG. 2 is an end view of the windshield holding side frame members of the windshield system.

FIG. 2 illustrates an end view of the windshield holding frame members 4. Each member 4 comprises a front plate 10 and a rear plate 11 connected by a connector 7 between the two plates to form channels between the plates, a support channel 9 on an outer side for attaching to a ridge on the frame members 4 to each support 3 and a windshield channel 8 on an inner side for slidably retaining an edge of the window 6.

Figure 3:
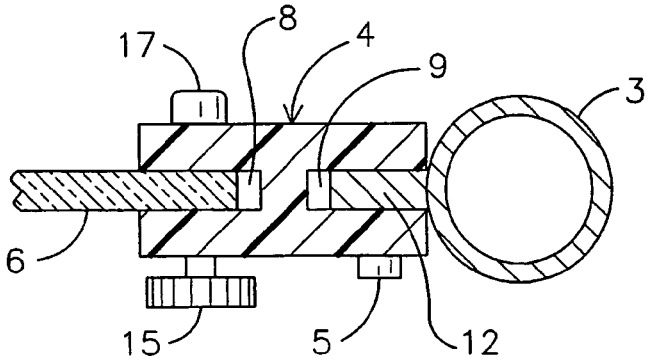
FIG. 3 is a downward cross-section of the side support section of the windshield system of the present invention along lines 3—3 of FIG. 1.

The cross section illustration of FIG. 3 depicts the integration of the windshield frame member 4 into T-top supports of a boat. In FIG. 3 the T-top side supports 3 are made so as to have an inward ridge 12 which is sized to be inserted into the channel 9 of the frame member 4 and secured to the ridge 12 via a plurality of fastening members, such as screws 5. The windshield window 6 is then slidably inserted into the channel 8 of the frame member 4. A knurled knob 5 with bolt 17 is shown for holding the window 6 in a clamping fashion in any desired open or closed position in the channel 8.

Figure 4:
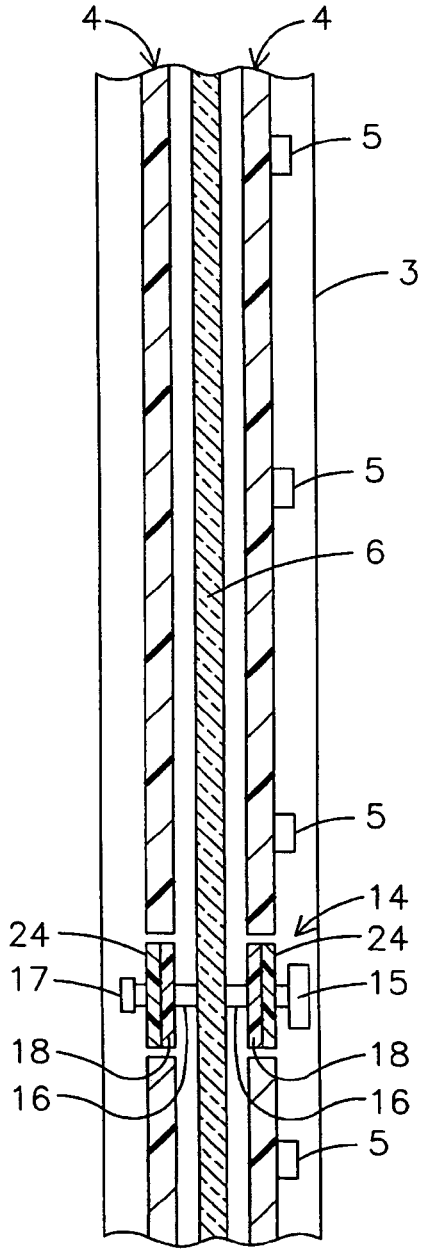
FIG. 4 is a lengthwise cross-section of the windshield support section of the present invention along lines 4—4 of FIG. 1.

FIG. 4 shows a cross section of the windshield system, particularly the clamping mechanism 14 which allows the window 6 to be held in any desired position. The clamping mechanism 14 employs at least a pair of plates 24, one on each side of the window 6 in the frame members 4. The plates 24 contain a hole through which a threaded bolt 16 is inserted, and having a nut 17 on one end and a rotatable knob 15 on the other end. The knob 15 can be rotated in one direction to press the plates 24 against the windshield window 6 so as to hold it at any desired position in the channel and in another direction to release the window 6 so it could be slidably moved to a closed or any desired open position. Although as illustrated the windshield clamp device 14 operates in a manual fashion, the raising, lowering and holding in place of windshield window 6 in the channels 8 could be motorized and activated by a push button, similar to that used to operate powered automobile windows.

In addition to having such a sliding windshield window on a front side of a T-top, similar fixed or sliding windows could also be secured to one or more sides of the T-top 2 by securing it between T-top supports 3 and rear T-top supports 21, side bottom crossbar, 22, and side top crossbar 23 as further illustrated in FIG. 1.

Although only a few embodiments of the present invention have been described in detail hereinabove, all improvements and modifications to this invention within the scope or equivalents of the claims are included as part of this invention. Accordingly, all such modifications are intended to be included in the scope of this invention.

What is claimed is:

1. An adjustably slidable windshield system for a boat, said windshield system comprising:

a window having front and back surfaces, a predetermined thickness, width and length;

a support attached to the boat on two sides of the window, each support having a channel of sufficient width to accommodate the thickness of the window wherein the window may slide within said channels; and a means for holding the window at a desired location in the channels comprising at least one clamp mechanism on at least one support.

2. The adjustably slidable windshield system of claim 1 further comprising:

at least one handle secured to the window for assisting the movement of the window to a desired location within the channel.

3. The adjustably slidable windshield system of claim 1 wherein the at least one clamp mechanism comprises two plates, one each on the front and back surfaces of the window proximate a channel, said plates being connected by a threaded bolt having a knob on one end and a nut on the other end, such that when the knob is rotated in one direction, the window is pressed between the plates to hold the window in a desired position and, when rotated in an opposite direction, pressure against the plates is released, thus allowing the window to slide within the channel.

4. An adjustably slidable windshield system for a boat, said windshield comprising:

a window having front and back surfaces, a predetermined thickness, width and length;

a support attached to the boat on two sides of the window, each support having an ridge along the length of the support on a side facing an edge of the window;

a frame member having front and back plates connected by a central piece to form a first channel on an outer side for insertion of the ridge into the first channel and a second channel on the inner side for inserting the edge of the window; and a means for holding the window at a desired location in the channel comprising at least one clamping mechanism on each frame member.

5. The adjustably slidable windshield system of claim 4 further comprising:

at least one handle secured to the window for moving the window to a desired location within the channel.

6. The adjustably slidable windshield system of claim 4 wherein the at least one clamp mechanism comprises two plates, one each on the front and back surfaces of the window proximate a channel, said plates being connected by a threaded bolt having a knob on one end and a nut on the other end, such that when the knob is rotated in one direction, the window is pressed between the plates to hold the window in a desired position and when rotated in an opposite direction, pressure against the plates is released, thus allowing the window to slide within the channel.

7. An adjustably slidable windshield system for a boat having a T-top mounted on at least two supports attached to a boat, said windshield system comprising:

a window having front and back surfaces, a predetermined thickness, width and length;

a support attached to the boat on two sides of the window, each support having a channel of sufficient width to accommodate the thickness of the window wherein the window may slide within said channels; and a means for holding the window at a desired location in the channel comprising at least one clamp mechanism on at least one support.

8. The adjustably slidable windshield system of claim 7 further comprising:

at least one handle secured to the window for moving the window to a desired location within the channel.

9. The adjustably slidable windshield system of claim 7 wherein the at least one clamp mechanism comprises two plates, one each on the front and back surfaces of the window proximate a channel, said plates being connected by a threaded bolt having a knob on one end and a nut on the other end, such that when the knob is rotated in one direction, the window is pressed between the plates to hold the window in a desired position and when rotated in an opposite direction, pressure against the plates is released, thus allowing the window to slide within the channel.

10. An adjustably slidable windshield system for a boat having a T-top mounted on at least two supports attached to a boat, said windshield system comprising:

a window having front and back surfaces, a predetermined thickness, width and length;

a support attached to the boat on two sides of the window, each support having a ridge along the length of the support on a side facing an edge of the window;

a frame member having front and back plates connected by a central piece to form a first channel on an outer side for insertion of the ridge into the first channel and a second channel on an inner side for inserting the edge of the window; and a means for holding the window at a desired location in the second channel comprising at least one clamp mechanism on a frame member.

11. The adjustably slidable windshield system of claim 10 further comprising:

at least one handle secured to the window for moving the window to a desired location within the channel.

12. The adjustably slidable windshield system of claim 10 wherein the at least one clamp mechanism comprises two plates, one each on the front and back surfaces of the window proximate the channel, said plates being connected by a threaded bolt having a knob on one end and a nut on the other end, such that when the knob is rotated in one direction, the window is pressed between the plates to hold the window in a desired position and when rotated in an opposite direction, pressure against the plates is released, thus allowing the window to slide within the second channel.

* * * * *